US007724914B2

(12) United States Patent
Akino

(10) Patent No.: US 7,724,914 B2
(45) Date of Patent: May 25, 2010

(54) DYNAMIC MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1064 days.

(21) Appl. No.: 11/167,090

(22) Filed: Jun. 28, 2005

(65) Prior Publication Data

US 2006/0002581 A1 Jan. 5, 2006

(30) Foreign Application Priority Data

Jun. 30, 2004 (JP) ..... 2004-192658

(51) Int. Cl.
*H04R 1/00* (2006.01)

(52) U.S. Cl. ..... 381/409; 381/400

(58) Field of Classification Search ..... 381/177, 381/412, 413; 181/157, 158, 166
See application file for complete search history.

(56) References Cited

U.S. PATENT DOCUMENTS 4,376,233 A * 3/1983 Kamon et al. ..... 381/409
5,148,492 A * 9/1992 Uzawa et al. ..... 381/177
7,274,798 B2 * 9/2007 Ohashi et al. ..... 381/430
2006/0088184 A1 * 4/2006 Ohashi et al. ..... 381/430

FOREIGN PATENT DOCUMENTS

JP 2001-86590 3/2001

* cited by examiner

*Primary Examiner*—Brian Ensey
*Assistant Examiner*—Sunita Joshi
(74) *Attorney, Agent, or Firm*—Manabu Kanesaka

(57) ABSTRACT

There is provided a dynamic microphone which prevents, with a simple configuration, the lead of a voice coil from breaking even when a strong sound pressure or the like presses a diaphragm to a magnetism generating circuit. The dynamic microphone includes a diaphragm 11 having a voice coil 12 attached to a boundary between a center dome 11*a* and a sub dome 11*b*, and a magnetism generating circuit 20 which has a pole piece 22 provided on one pole of a permanent magnet 21, a ring yoke 24 provided on the other pole of the permanent magnet 21, and a magnetic gap formed between the pole piece 22 and the ring yoke 24, the voice coil 12 being supported in the magnetic gap so as to vibrate through the diaphragm 11, the voice coil 12 having a lead 12*a* wired along the inner surface of the sub dome 11*b*, wherein the lead 12*a* of the voice coil 12 is elastically held on the sub dome 11*b* at least through an elastic layer 30 applied to the inner surface of the sub dome 11*b* adjacent to the voice coil 12.

3 Claims, 2 Drawing Sheets

DYNAMIC MICROPHONE

TECHNICAL FIELD

The present invention relates to a dynamic microphone and more specifically relates to a dynamic microphone which makes it possible to effectively prevent the lead of a voice coil from breaking when a diaphragm undergoes an excessive displacement.

BACKGROUND ART

FIG. 3 is a sectional view showing a main part of an example of a conventional dynamic microphone. The basic configuration of the microphone comprises a vibration part 10 vibrating with sound waves and a magnetism generating circuit 20. The vibration part 10 comprises a diaphragm 11 and a voice coil (generator coil) 12. In this case, the diaphragm 11 has a center dome 11*a* and a sub dome 11*b* provided around the center dome 11*a*. The voice coil 12 is joined to a boundary between the center dome 11*a* and the sub dome 11*b* with an adhesive.

The magnetism generating circuit 20 comprises a permanent magnet 21, a pole piece 22 provided on one pole of the permanent magnet 21, and a ring yoke 24 magnetically connected to the other pole of the permanent magnet 21 via a cup-like yoke 23. The voice coil 12 is supported in a magnetic gap formed between the pole piece 22 and the ring yoke 24 so as to vibrate through the diaphragm 11. A lead 12*a* of the voice coil 12 is wired along the inner surface of the sub dome 11*b* and routed to a signal output circuit (not shown).

Incidentally, for picking up sound of musical instruments, dynamic microphones enabling preferred sound quality are used frequently. Particularly when a bass drum is used as a musical instrument, a dynamic microphone is placed in the bass drum to pick up the sound.

Dynamic microphones for base drums pick up heavy bass, and thus in general designs, diaphragms have low stiffness (soft diaphragms) and voice coils are heavy. The bass resonance frequency of dynamic microphones for bass drums is set low, and thus an amplitude is extremely large around a resonance frequency in actual sound pickup. For example, the amplitude sometimes reaches about ±0.5 mm.

When a base drum is strongly hit, an internal pressure rapidly increases, an air current caused by the increased pressure instantly flows from an opening of the drum to the outside, and then the air current strongly presses the diaphragm 11 to the magnetism generating circuit 20 as shown in FIG. 4. Since an amplitude is extremely large at this point, the lead 12*a* of the voice coil 12 may strongly strike a corner of the ring yoke 24 and break thereon. The lead 12*a* may be broken also by a drop impact and the like.

As a method for preventing this problem, patent document 1 (Japanese Patent Application Publication No. 2003-1191) discloses a method of elastically supporting a magnetism generating circuit through a suspension.

However, the technique described in patent document 1 requires the suspension and a structure becomes complicated accordingly, resulting in high cost. As shown in FIG. 3, the magnetism generating circuit 20 has an extremely narrow gap, and thus when the magnetism generating circuit is elastically supported through a suspension as in the technique disclosed in patent document 1, the voice coil 12 of FIG. 3 may come into contact with the magnetism generating circuit 20.

SUMMARY OF THE INVENTION

In view of the problem of the conventional technique, an object of the present invention is to provide a dynamic microphone which makes it possible to minimize cost and the complication of a structure, and prevent, with a simple configuration, the lead of a voice coil from breaking even when a strong sound pressure or drop impact presses a diaphragm to a magnetism generating circuit.

The present invention is devised to attain the object. A dynamic microphone including a diaphragm having a voice coil attached to a boundary between a center dome and a sub dome, and a magnetism generating circuit having a magnetic gap formed between a pole piece provided on one pole of a permanent magnet and a ring yoke provided on the other pole of the permanent magnet, the voice coil being supported in the magnetic gap so as to vibrate through the diaphragm, the voice coil having a lead wired along the inner surface of the sub dome facing the ring yoke, wherein the sub dome has an elastic layer made of an elastic adhesive on the inner surface, and the lead has a lead end at least a part of which is elastically held on the sub dome through the elastic layer.

In this case, it is preferable that the elastic layer be formed over the inner surface of the sub dome. Further, it is desirable that the elastic layer be formed by applying an adhesive solidifying with elasticity.

With this configuration, the lead end of the lead of the voice coil is elastically held through the elastic layer provided on the inner surface of the sub dome. Thus, even when the diaphragm is strongly pressed to the magnetism generating circuit, the cushion effect of the elastic layer can positively prevent a break.

Moreover, the elastic layer is formed, including the lead end of the lead, over the inner surface of the sub dome adjacent to the voice coil, thereby effectively preventing abnormal resonance of the sub dome. The abnormal resonance causes a large peak and dip in directional frequency response at a resonance frequency.

Further, the elastic layer is formed using an elastic adhesive which is a rubber adhesive including a silicon resin adhesive, thereby obtaining more preferable elasticity. It is desirable that the elastic adhesive have a hardness not seriously interfering with the vibration of the diaphragm when hardened.

DETAILED DESCRIPTION

Figure 1:
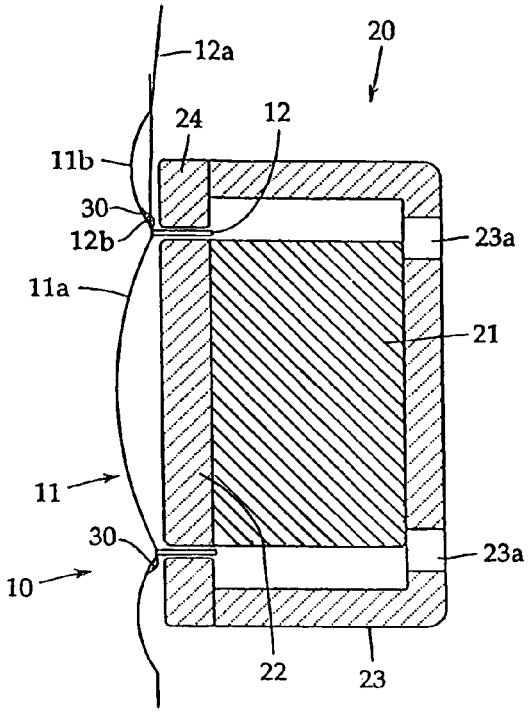
FIG. 1 is a sectional view showing a main part of a dynamic microphone according to the present invention.
Figure 2:
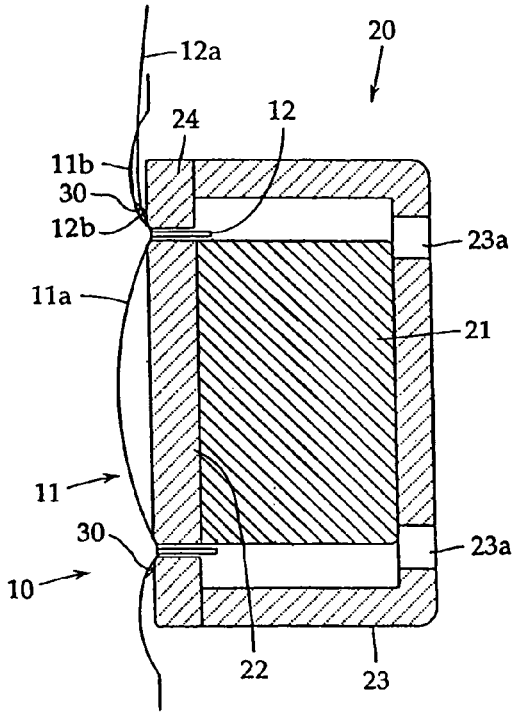
FIG. 2 is a sectional view showing the maximum displacement of a diaphragm of the dynamic microphone according to the present invention.
Figure 3:
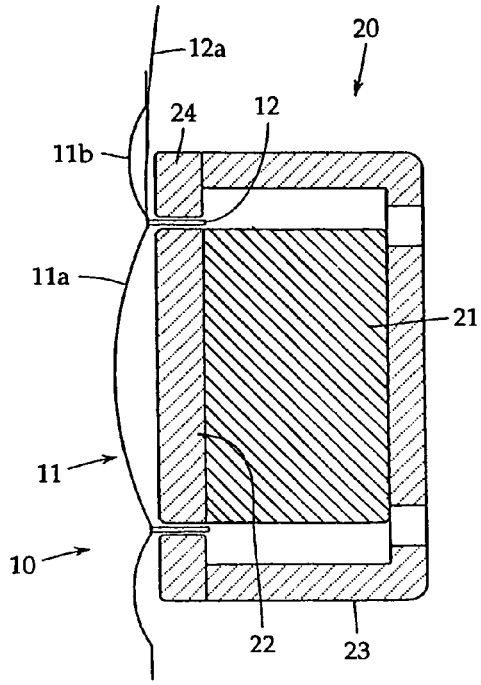
FIG. 3 PRIOR ART
FIG. 3 is a sectional view showing a main part of a conventional dynamic microphone.
Figure 4:
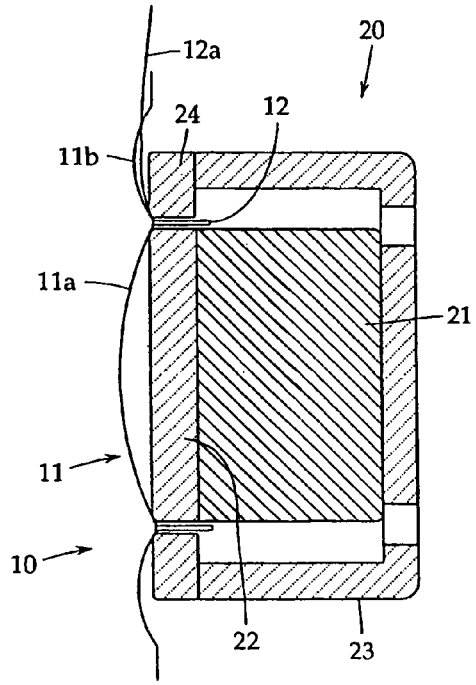
FIG. 4 PRIOR ART
FIG. 4 is a sectional view showing the maximum displacement of a diaphragm of the conventional dynamic microphone.

Referring to FIGS. 1 and 2, an embodiment of the present invention will be discussed below. The present invention is not limited to this embodiment. FIG. 1 is a sectional view showing a main part of a dynamic microphone according to the present invention. FIG. 1 corresponds to FIG. 3, and constituent elements not to be changed from those of the conventional example are indicated by the same reference numerals. FIG. 2 is a sectional view which shows the maximum displacement of a diaphragm in a similar manner to FIG. 4.

As shown in FIG. 1, the dynamic microphone comprises, as a basic configuration, a vibration part 10 vibrating with sound waves and a magnetism generating circuit 20. The vibration part 10 includes a diaphragm 11 and a voice coil 12.

The diaphragm 11 has a center dome 11*a* and a sub dome 11*b* coaxially provided around the center dome 11*a*. The center dome 11*a* and the sub dome 11*b* are integrally formed of an extremely thin (e.g., about 9 μm) synthetic resin film. The center dome 11*a* and the sub dome 11*b* are formed by heating and molding a single synthetic resin film.

The voice coil 12 is composed of a copper wire, which has an insulating coating, with a wire diameter of, e.g., about 25 μm. The voice coil 12 is joined as a generator coil to a boundary between the center dome 11*a* and the sub dome 11*b* with an adhesive while being wound a predetermined number of turns.

The magnetism generating circuit 20 comprises a permanent magnet 21, a pole piece 22 provided on one pole of the permanent magnet 21, and a ring yoke 24 magnetically connected to the other pole of the permanent magnet 21 via a cup-like yoke 23.

In this example, rear acoustic terminal holes 23*a* for an operation of a unidirectional microphone are bored through the cup-like yoke 23. The dynamic microphone of the present invention may not have the rear acoustic terminal holes 23*a*, in other words, the dynamic microphone may be omnidirectional.

The ring yoke 24 is disposed around the pole piece 22 with a predetermined magnetic gap. In the magnetic gap, the voice coil 12 is supported so as to vibrate through the diaphragm 11. The edge of the sub dome 11*b* is fixed to a housing (not shown).

The voice coil 12 has a lead 12*a* wired along the inner surface of the sub dome 11*b* (a surface facing the ring yoke 24) and the other end of the voice coil 12 is routed to a signal output circuit (not shown).

An elastic layer 30 made of an elastic adhesive is provided between the voice coil 12 and the inner surface of the adjacent sub dome 11*b*. The lead 12*a* has a lead end 12*b* elastically held on the sub dome 11*b* through the elastic layer 30. With this configuration, for example, when the dynamic microphone is used for a bass drum and a strong sound pressure or drop impact causes an excessive displacement (the diaphragm 11 is pressed to the magnetism generating circuit 20) on the diaphragm 11, it is possible to prevent the lead 12*a* of the voice coil 12 from directly coming into contact with a corner of the ring yoke 24, thereby positively preventing a break.

Additionally, the elastic layer 30 is formed over the inner surface of the sub dome 11*b* adjacent to the voice coil 12, thereby effectively preventing abnormal resonance of the sub dome 11*b*. The abnormal resonance causes a large peak and dip in directional frequency response at a resonance frequency.

For the elastic layer 30, it is possible to use an elastic adhesive which can exhibit adhesion while keeping proper elasticity not interfering with the vibration of the diaphragm. For example, in addition to a rubber adhesive including a silicon resin adhesive, an ultraviolet curing adhesive and an acrylic adhesive are also available.

The above explanation described the present invention in accordance with the illustrated example. The specific configuration is not limited to this example. For example, the elastic layer 30 may be formed only on the inner surface of the sub dome 11*b*, which faces the lead end 12*b* of the lead 12*a*, to hold the lead end 12*b*. Further, the elastic layer 30 may be applied so as to hold the lead end 12*b* of the lead 12*a* and formed so as to be dotted in the circumferential direction instead of over the inner surface of the sub dome 11*b* adjacent to the voice coil 12.

The present application is based on, and claims priority from, Japanese Application Serial Number JP2004-192658, filed Jun. 30, 2004, the disclosure of which is hereby incorporated by reference herein in its entirety.

The invention claimed is:

1. A dynamic microphone comprising:

a diaphragm including a center dome, a sub dome arranged around the center dome, and a voice coil attached to a boundary between the center dome and the sub dome, said voice coil having a lead arranged along an inner surface of the sub dome, a magnetism generating circuit including a permanent magnet, a pole piece provided on one pole of the permanent magnet, a ring yoke provided on the other pole of the permanent magnet and arranged to face the sub dome, and a magnetic gap formed between the pole piece and the ring yoke, the voice coil being supported in the magnetic gap so as to vibrate through the diaphragm, and an elastic layer made of an elastic adhesive and provided on an inner surface of the sub dome facing the ring yoke, said elastic layer fixing only a lead end of the lead onto the sub dome without attaching the sub dome to other member and projecting toward the ring yoke beyond the lead end to protect the lead end from colliding with the ring yoke, wherein the elastic layer provided on the inner surface of the sub dome has an annular shape without interruption over the inner surface of the sub dome to resiliently support the diaphragm relative to the magnetism generating circuit, thereby effectively preventing abnormal resonance of the sub dome, in addition to fixing the lead end of the lead onto the sub dome.

2. The dynamic microphone according to claim 1, wherein the elastic layer is a rubber adhesive including a silicon resin adhesive.

3. The dynamic microphone according to claim 2, wherein the ring yoke has a cup shape having rear acoustic terminal holes.

* * * * *